US006027003A

United States Patent [19]

Gassner

[11] Patent Number: 6,027,003

[45] Date of Patent: Feb. 22, 2000

[54] APPARATUS FOR TURNING OR DISPLACING A WEB OF CONTINUOUS RECORDING MATERIAL

[75] Inventor: Günther Gassner, Mühldorf, Germany

[73] Assignee: Océ Printing Systems GmbH, Poing, Germany

[21] Appl. No.: 09/065,056

[22] PCT Filed: Aug. 2, 1996

[86] PCT No.: PCT/DE96/01449

§ 371 Date: Sep. 23, 1998

§ 102(e) Date: Sep. 23, 1998

[87] PCT Pub. No.: WO97/18951

PCT Pub. Date: May 29, 1997

[30] Foreign Application Priority Data

Oct. 27, 1995 [DE] Germany ..... 195 40 134

[51] Int. Cl.[7] ..... B65H 20/24; B65H 23/32; B41F 5/04

[52] U.S. Cl. ..... 226/118.3; 101/223; 226/196.1; 242/615.21; 399/402

[58] Field of Search ..... 242/615.21; 226/118.2, 226/118.3, 196.1; 101/223; 399/401, 402

[56] References Cited

U.S. PATENT DOCUMENTS

| | | | |
|---|---|---|---|
| 180,092 | 7/1876 | House | 226/196.1 X |
| 3,548,783 | 12/1970 | Knapp | 242/615.21 X |
| 4,256,248 | 3/1981 | Lapp et al. | 226/196.1 X |
| 4,343,422 | 8/1982 | Dabringhaus et al. . | |
| 4,412,639 | 11/1983 | Caletti | 242/615.21 |
| 5,092,573 | 3/1992 | Abreu . | |
| 5,108,022 | 4/1992 | Birkmair et al. | 242/615.21 |
| 5,350,246 | 9/1994 | Sehringer . | |
| 5,374,042 | 12/1994 | Ring | 242/615.21 X |
| 5,546,178 | 8/1996 | Manzer et al. | 399/401 X |
| 5,778,297 | 7/1998 | Reichl et al. | 399/401 X |
| 5,797,079 | 8/1998 | Creutzmann et al. | 399/401 X |
| 5,848,345 | 12/1998 | Stemmle | 399/401 |

FOREIGN PATENT DOCUMENTS

| | | |
|---|---|---|
| 0 611 717 | 8/1994 | European Pat. Off. . |
| 0 697 634 | 2/1996 | European Pat. Off. . |
| 35 28 784 | 2/1987 | Germany . |
| 38 16900 | 11/1989 | Germany . |
| 40 10 152 | 10/1991 | Germany . |
| WO 94/27193 | 11/1994 | WIPO . |

OTHER PUBLICATIONS

Japanese Abstract, 55084633, Jun. 26, 1980, European Patent Office.

Arseneault et al., "Helical Compliant Guide", IBM Technical Disclosure Bulletin, vol. 16, No. 11, Apr. 1974, p. 3494.

*Primary Examiner*—Michael R. Mansen
*Attorney, Agent, or Firm*—Hill & Simpson

[57] ABSTRACT

An apparatus for turning and displacing a web of continuous recording material in a printer or copier provides that the web is conveyed along a transport path by a web supply, around a deflection device below the web supply, and to a web take-up that is spaced by at least one web width from the deflection device. The first edge of the web facing the take-up device lies loosely on a first guide surface of the deflection device. The web may also be displaced without turning.

16 Claims, 7 Drawing Sheets

APPARATUS FOR TURNING OR DISPLACING A WEB OF CONTINUOUS RECORDING MATERIAL

BACKGROUND OF THE INVENTION

1. Field of the Invention

The present invention relates to a means for turning and displacing a web of endless recording material, in particular a paper web in an electrographic printer. Furthermore, the invention relates to a means in which the web of endless recording material is only displaced in parallel fashion.

2. Description of the Related Art

Means of this sort are important components of an electrographic printer means for printing on strip-type recording media of various widths. A printing means of this sort is for example specified in International Published application No. WO/94 27193. The printer means has an intermediate carrier that operates electrographically, for example a photoconductor drum, with a usable width corresponding to twice the width of a standard form, e.g. DIN A4 or letter size. The additional components, such as the fixing station, the developer station, the cleaning station, etc., are likewise designed with this usable width.

With this known printer means, different types of operation are possible. In monochromatic duplex operation, the web of endless recording material is turned during its transport through the printer means, so that two web segments result: in a first web segment, the front side of the web lies opposite the transfer printing location of a print unit, whereas in a second web segment the back side of the web is simultaneously imprinted at the same transfer printing location. By means of the use of differently colored color particles in different developer units of the print unit, a two-color duplex operation is also possible. In another type of operation, two-color simplex operation, the web is displaced in parallel fashion during transport in the printer means by at least a web width. The displaced web segments are together led past the transfer printing location, in a side-by-side position. As the web first passes by the transfer printing location, image and text elements are printed with a first color; in the second pass of the web, with a lateral displacement, image and text elements are printed with the second color.

For completeness, we also refer to simplex operation and parallel simplex operation. In the first-named simplex operation, a recording medium is imprinted in a conventional way with up to doubled the width of a DIN A4 page or a page with letter size format. In parallel simplex operation, two webs separated from one another, e.g. respectively having a width according to the DIN A4 or letter size format, are guided side-by-side through the printer means and are imprinted.

In the imprinting of a single web that is displaced in parallel in the printer, or is displaced in parallel and also turned, and again supplied to the transfer printing location of the print unit and imprinted, it is to be ensured that the parallel displacement or parallel displacement with simultaneous turning takes place without disturbance and with high precision. With the use of a means for turning and/or for displacement of a web in a high-performance printer that reaches web transport speeds in the range of 0.1 to 2.5 m/s, measures are to be provided that enable a rapid passage of the web, even with the use of foldable endless material with folds.

From the German patent application 94 112 973.6, a turning means is known for strip-type recording media in which diverting elements are arranged in order to divert the web in the shape of a W. The web is guided tautly through the turning means and is in close contact with the diverting units.

From a further German patent application, P 44 35 756.7, a turning means is known for strip-type recording media whose diverting elements form two turning triangles. The turning triangles are arranged so as to be rotated relative to one another by a spread angle, so that the overall turning means takes up little space.

An object of the invention is to provide a means for displacing, or for displacing and turning, a web, which is of simple construction and ensures disturbance-free operation.

This and other objects and advantages are provided by a means for turning and displacing a web of endless recording material by means of a web supply that guides the web along a first transport path from a transport direction, and having a web take-up that carries away the web, displaced by at least a web width, after its circuit about a diverter that is arranged underneath and after the web supply means (as seen in the direction of transport), the web take-up being arranged above the diverter and next to the web supply, whereby a first edge, facing the web take-up, of the supplied web rests loosely on a first guide surface of the diverter, and the web is guided upwards at an angle to the web take-up with this first edge, and on which the side facing the web supply is carried off along a second transport path, approximately in the direction of transport. For a means exclusively for displacing a web, without turning it, this object is solved by means of a web supply that supplies the web along a first transport path from a direction of transport, and having a web take-up that carries off the web, displaced by at least a web width, after it passes through a loosely hanging web loop, the output means being arranged above the web loop and next to the web supply, whereby the web take-up carries away the web along a second transport path, approximately in the direction of transport, with a first edge, facing the web take-up, of the supplied web on the side facing the web supply. Advantageous developments of the invention are provided by diverter having an oblong body whose longitudinal axis runs approximately vertically, and in that the first guide surface is convexly curved. Preferably, the body has a cylindrical lower segment. The body has a second guide surface in its upper region, which surface guides and holds down the second edge, facing the first edge, of the web, when the web climbs up during its circuit about the body and exceeds a predetermined height. The second guide surface is formed by spread-out arms in the manner of a Y, and in that the arms lie within a plane that is at least approximately parallel to the web segment shortly after the supplying by means of the web supply. The arms run spread out at an angle of 30° to 60°, preferably 45°, from the longitudinal axis of the body.

Alternately, the body is fashioned as a rotational body. The rotational surface of the rotational body is Y-shaped.

As another alternative, the body has, at least in its upper part, the shape of an inverted truncated cone.

The first and the second guide surfaces are adjustable in height. The height adjustment takes place dependent on the required length of the web loop for a loop storage unit.

The preferred web take-up contains a guide element that is arranged approximately in a horizontal plane and that has a guide surface via which the web is guided after passing through the web loop, and the longitudinal axis of the guide surface encloses an angle in the range of 15° to 45°, preferably 20°, with the longitudinal axis, projected in the horizontal plane, of the web supply means.

The guide surface is convexly curved in one embodiment. The web output contains a diverting element to which the web guided via the guide element is supplied directly, and in that the web is supplied to the diverting element from below, coming from the direction of the guide element, and is diverted in the direction of transport. The guide element can be pivoted by the angle out of a first position, in which the guide surface is arranged parallel to the axis of the diverting element, and can be fixed in this pivoted position.

The guide element, and preferably also the diverting element, each have a stop on the side facing the web supply means, on which stop the edge of the web rests.

The web supply means contains a transport roll, as well as at least one counterpressure roll, between which the web is supplied.

A web guide, which enables a calmed and loose supplying of the web, is arranged underneath the web supply. The web supply has a support surface, preferably concavely curved, with a width that corresponds to at least the width of the web. The web guide contains a movable support element that moves the front side of the web against the support surface with friction. The support element is fashioned by a number of spiral springs arranged next to one another. The support element may instead be fashioned by a felt tab or a material tab.

A guide element is arranged underneath the web supply means, the guide element guiding the front segment of the web during the supply thereof in a predetermined direction, preferably in the direction of an operator. The guide element has a curved support surface for the first segment of the web, as well as a lower contact surface for an edge of the web. The support surface is preferably made of a material that does not become electrostatically charged during the movement of the web.

According to the first aspect of the invention, in which the web is turned and displaced, this web is guided loosely around a diverting means, whereby the first edge is supplied to the diverting means at an angle from the top downward, and there is led upward again from below, coming upward at an angle. The edge rests on the first guide surface of the diverting means, so that a loop forms naturally from the web supply means up to the web output means. Since this first edge rests loosely on the first guide surface, the web loops can describe excursion movements in the vertical direction, thus compensating for fluctuations in the transport speed in the area of the diverting means. Such fluctuations can for example arise due to changes in the friction relationships, or due to the formation of folds. The invention is suited both for webs of endless material without folds running transversely and also for webs with folds (such as fan-fold webs).

In the invention, the web surfaces come into frictional contact with only a few elements. In this way, the risk of web jamming due to different frictional conditions, or damage to the web, is reduced. The surfaces of the mechanical guides that are in contact with the web can be provided with very low-friction surfaces, or can be made resistant to wear by means of a surface treatment. The operational reliability of the means is thereby further increased.

In practice, it has turned out that web speeds of up to 2.5 m/s and higher are under control, and the requirements for use in high-performance printers are fulfilled. In the upper web speed range, the web run is particularly stable.

The first guide surface is preferably convexly curved. It is thereby adapted to the curvature of the geometry of the web loop, which geometry forms automatically due to the weight of the web and its elasticity; the first guide surface supports the natural loop formation.

An exemplary embodiment of the invention is characterized in that the oblong body of the diverting means has in its upper region a second guide surface that guides and holds down the second edge—lying opposite the first edge—of the web when the web climbs up in its motion around the body and exceeds a predetermined height. By means of these measures, the vertical excursion motion of the loop on the loop base is limited to a predetermined measure. If, due to a disturbance, the uniformity of the web transport is disturbed, e.g. due to buckling in of the web at the fold points of a fan-fold web, the web loop is shortened, which is expressed in a climbing up of the web at the first guide surface. Past a predetermined height, the upper, second edge of the web comes to rest on the second guide surface, whereupon the tensile stress on the second edge of the web is increased, and the web becomes taut, and thereby unfolds. Disturbances during the passage of the web are thus automatically compensated.

According to a further exemplary embodiment of the invention, the first and second guide surfaces can be adjusted in height. By this means, on the one hand the diverting means can be adapted to different widths of the web. On the other hand, the height adjustment enables adaptation to the length of the web loops from the web supply means to the web output means. This web loop also serves as a web storage means whose length is set dependent on the utilized length format of the pages of the web, and is predetermined by the printer controller or by the operating personnel.

According to a further aspect of the invention, a means for displacing a web of endless recording material is provided, having a web supply means that supplies the web along a first transport path from a direction of transport, and having a web output means that carries off the web, displaced by at least a web width, after it passes through a loosely hanging web loop, the output means being arranged above the web loop and next to the web supply means, whereby the web output means carries away the web along a second transport path, approximately in the direction of transport, with a first edge, facing the web output means, of the supplied web on the side facing the web supply means. In this means, no turning of the web takes place. The means is constructed in such a way that the web forms a loop that hangs loosely. The web is thereby guided in such a way that the first edge—facing the web output means—of the supplied web is carried away, on the side turned away from the web supply means, along a second transport path, approximately in the transport direction. The upper side of the web on the second transport path and the upper side of the web of the first transport path align with one another. This means is thus used for two-color simplex operation.

The solution of the problem posed according to this aspect of the invention is surprisingly simple, and the web loop that forms naturally due to the force of gravity enables displacement by at least a web width. Due to the weight of the web, the web loop remains stable in shape even at high transport speed. Both webs provided with folds and also smooth webs can be transported and displaced.

In a preferred exemplary embodiment of the invention, the web output means contains a guide element—arranged at least approximately in a horizontal plane—with a guide surface via which the web is guided after passing through the web loop, whereby the longitudinal axis of the guide surface encloses an angle in the range from 15° to 25°, preferably 20°, with the longitudinal axis of the web supply means, projected in the horizontal plane. Due to its angled arrangement, this guide element enables the natural loop shape to be maintained, and enables the avoidance of small curvature radii during diversion into the transport path displaced in parallel fashion, which small radii can cause the formation of folds. With the use of folded recording material, the guide element prevents buckling of the web at the folds.

In order to avoid creasing or formation of folds in the recording material, the web leaving the guide element is supplied from below directly to a diverting element, which diverts the web in the direction of the web loop. The diverting element has a longitudinal axis that is at least approximately parallel to the longitudinal axis of the web supply means. The diverting element prevents a curvature of the web that can result due to the displacement of the web by at least a web width.

In an exemplary embodiment, the guide element, and preferably also the diverting element, can each have a stop on the side facing the web supply means, an edge of the web resting on this stop. Defined edge positions of the web, and a precise guiding, thus result during print operation.

BRIEF DESCRIPTION OF THE DRAWINGS

Exemplary embodiments of the invention are explained in the following on the basis of the drawings.

DETAILED DESCRIPTION OF THE PREFERRED EMBODIMENTS

Figure 1:
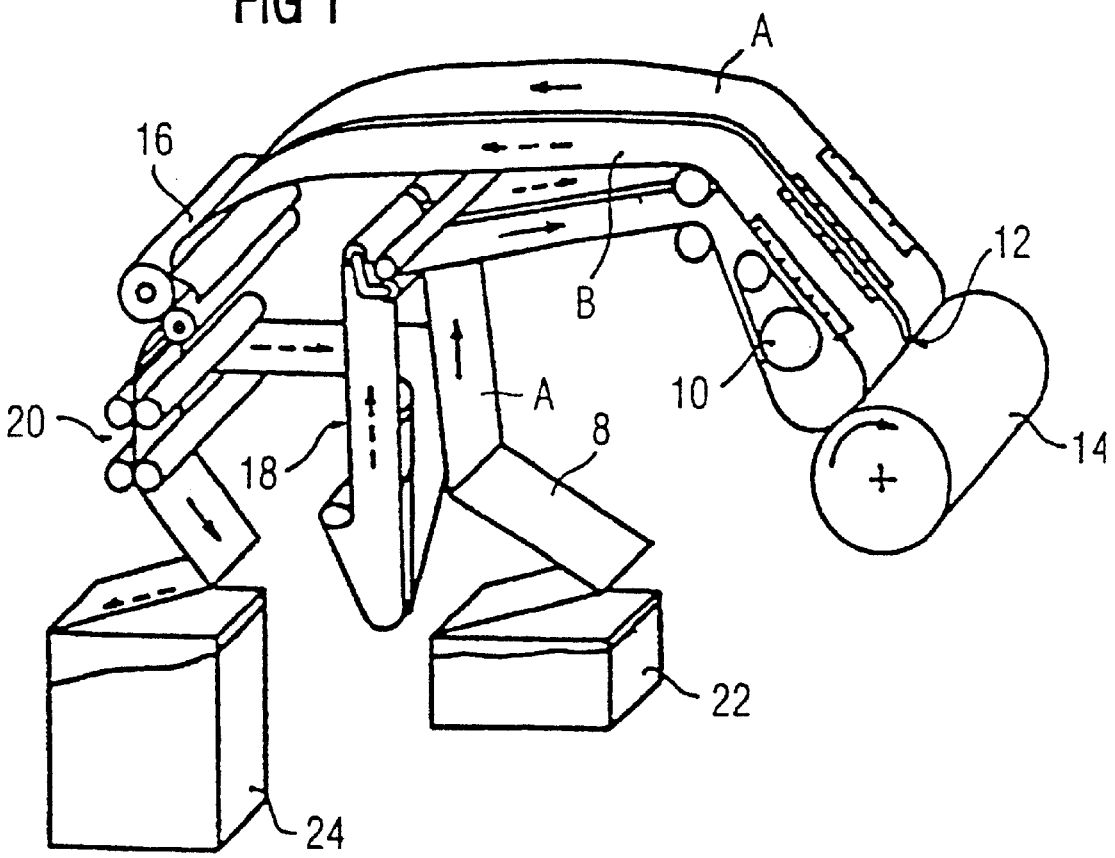
FIG. 1 is a perspective view which shows a high-performance printer in duplex operation with a turning means.

In the following, details of the invention are specified for the use of a high-performance printer that operates in the operating modes already specified. In FIG. 1, the high-performance printer is shown in duplex operation, in which a single web 8 is imprinted on its front and back side. The printer has a transport means 10, which, arranged near a print unit 12, conveys the web 8 through the print unit 12, in which a charge image made on a photoconductor drum 14 and colored in with toner is transferred onto the web 8 by means of a corona means (not shown). Subsequently, the web 8 is supplied to a fixing station 16, in which the toner image, which is still smudgeable, is bonded in smudge-resistant fashion with the carrier material, with the aid of pressure and temperature. The web 8 is supplied to the print unit 12 with a first web segment A, coming from a first stack 22. After imprinting and fixing, the web 8 is supplied to a turning means 18 via a diverting unit 20. This turning unit 18 turns the web 8 and displaces it laterally by at least a web width, so that now the back side of the web 8 can be supplied to the print unit 12 for imprinting, as web segment B. The imprinted web segment B is likewise supplied to the fixing station 16, which bonds the print image on the back side of the web 8 to the surface of the carrier material in smudge-resistant fashion. The web 8 is subsequently stacked onto a stack 24.

The transport unit 10, the print unit 12, the photoconductor drum 14 and the fixing station 16 have an operating width of at least twice the width of the web 8. In the present case, the printer is equipped with a photoconductor drum 14. In place of the photoconductor drum 14, a strip-type intermediate carrier can also be used, e.g. an OPC strip or a magneto-style arrangement. Further components for the electrographic print process are grouped around the photoconductor drum 14. These components, as well as the design of the overall printer, are specified in more detail in the German patent application P 44 35 756.7, the content of the disclosure of this application being included in the present application by reference.

Figure 2:
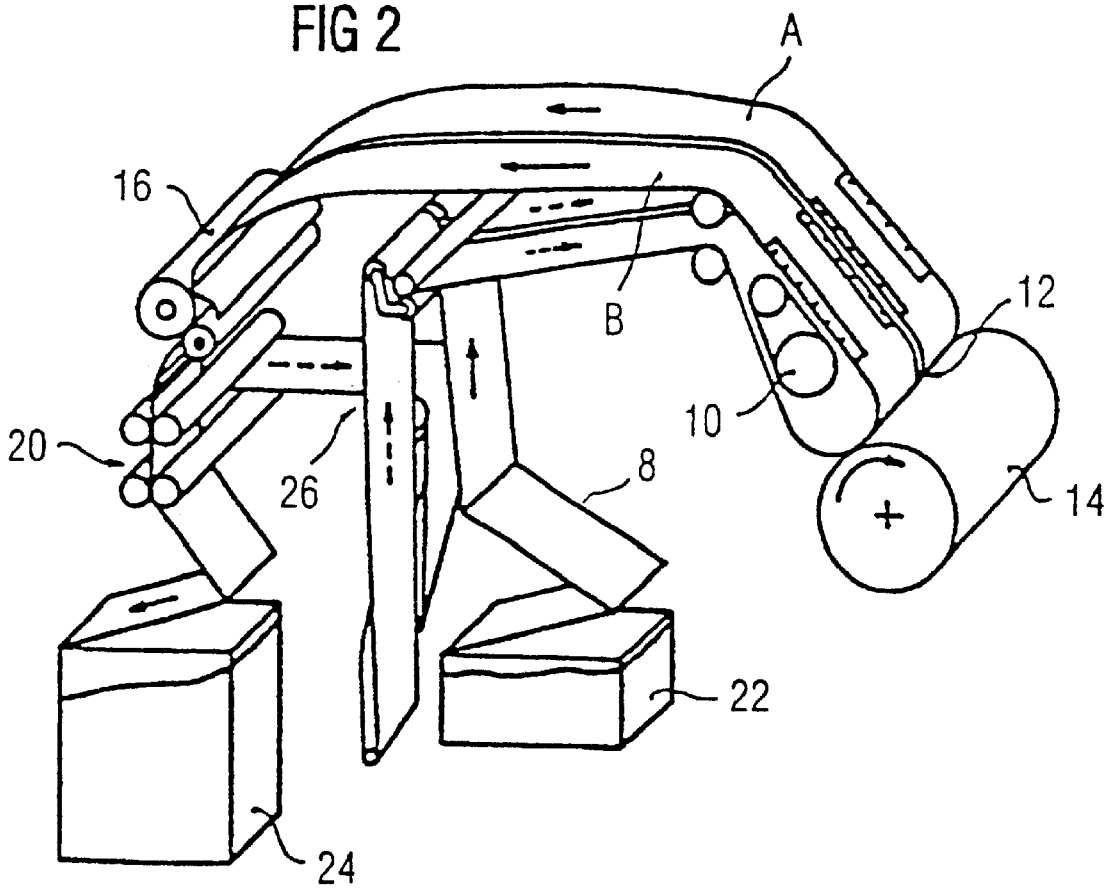
FIG. 2 is a perspective view which shows the high-performance printer in two-color simplex printing with a displacement means.

FIG. 2 shows the printer in two-color simplex operation, in which the front side of the web 8 is imprinted with a first color during a first passage by the print unit 12, and in which the front side of the web 8 is imprinted with a second color during a subsequent second passage by the print unit 12. Since the front side of the web 8 is to be printed in each of the two circuits, a displacement means 26 is provided at the point of separation between the web segments A and B, which displacement means displaces the web 8 in a parallel fashion by at least a web width, but does not turn the web.

In FIGS. 1 and 2, the web 8 is present in stacked form. For high-performance printers, the web 8 is often wound on a roll. Both folded webs (fan-fold webs) and also smooth webs without folds can be processed.

Figure 3:
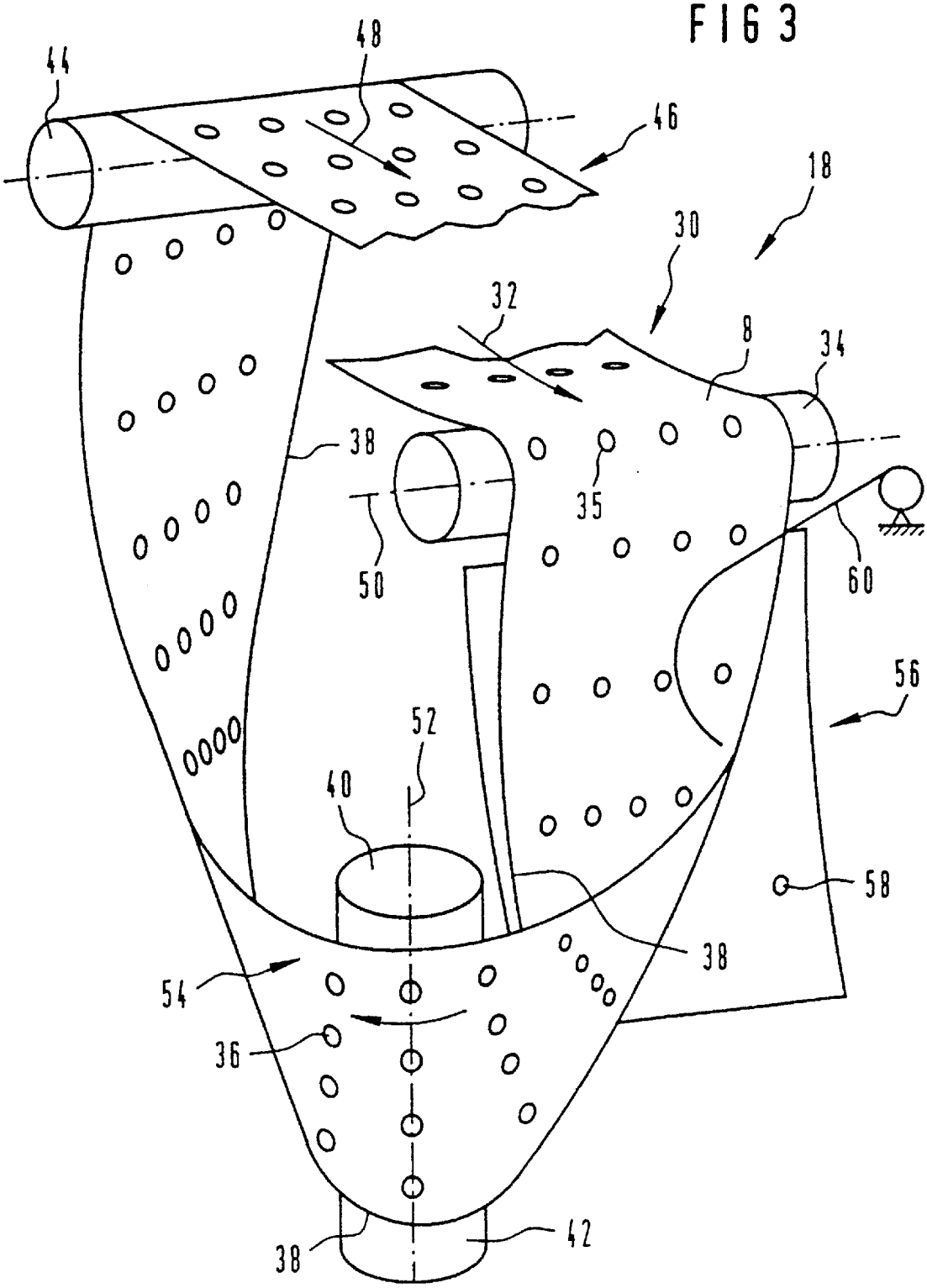
FIG. 3 is a schematic view of a turning means according to the invention.

FIG. 3 schematically shows an exemplary embodiment of the turning means 18 for the printer, which is operating in the duplex operation. The web 8 is supplied from a transport means according to the arrow 32 via a web supply means 34, along a first transport path 30 (details of this transport path 30 have been omitted in the figures, for better surveyability). In the example shown here, this web supply means 34 is realized by a roll. In practice, the web supply means 34 can contain several rolls and diverting units, in order to realize a specific web guidance, dependent on the geometrical characteristics of the printer. The web 8 has a front side, identified by circles 35, and a back side, identified by circles 36.

The web 8 is guided loosely around a diverting means 40 which is arranged vertically underneath the web supply means 34, so that its edge 38 rests loosely on a guide surface 42 of the diverting means 40. The front side of the web 8 faces this guide surface 42. The web 8 is guided obliquely upwards to a web output means 44, and is there diverted into a second transport path 46, which is arranged parallel to the first transport path 30. The edge 38 faces the web supply means 34.

The direction of transport (as indicated by the arrow 48) of the transport path 46 agrees approximately with the direction of transport (as shown by the arrow 32) of the transport path 30. Both transport paths 30 and 46 convey the web 8 downstream, in the direction of the print unit of the printer.

The axes 48 and 50 of the web output means 44 and of the web supply means 34 are oriented in parallel to one another. The longitudinal axis 52 of the diverting means 40 is arranged vertically.

As can be seen in FIG. 3, under the effect of the weight of the web 8 there forms a natural, loose web loop 54, whose shape also remains relatively stable during web transport at high speed. This is due to the fact that the inner edge 38 is guided on the guide surface 42, which has a convex curvature. This curvature supports the formation of a loop, even when the web 8 has folds.

The formation of a stable web loop 54 is further supported by a web guiding means 56 that has a concavely curved guide plate 58 and a movable support element 60 that is fixed at one end. The guide plate 58 is arranged just underneath the web supply means 34, and has a width that is at least that of the web 8. The support element 60 can be formed by a number of spiral springs arranged next to one another (not shown). The support element 60 rests frictionally on the front side of the web 8, and moves this web against the guide plate 58. By this means, a curving up of the recording material, which can occur in particular at folding points of the web 8, is counteracted, and the undesired movement of the web in the initial region of the web loop 54 is calmed.

Figure 4:
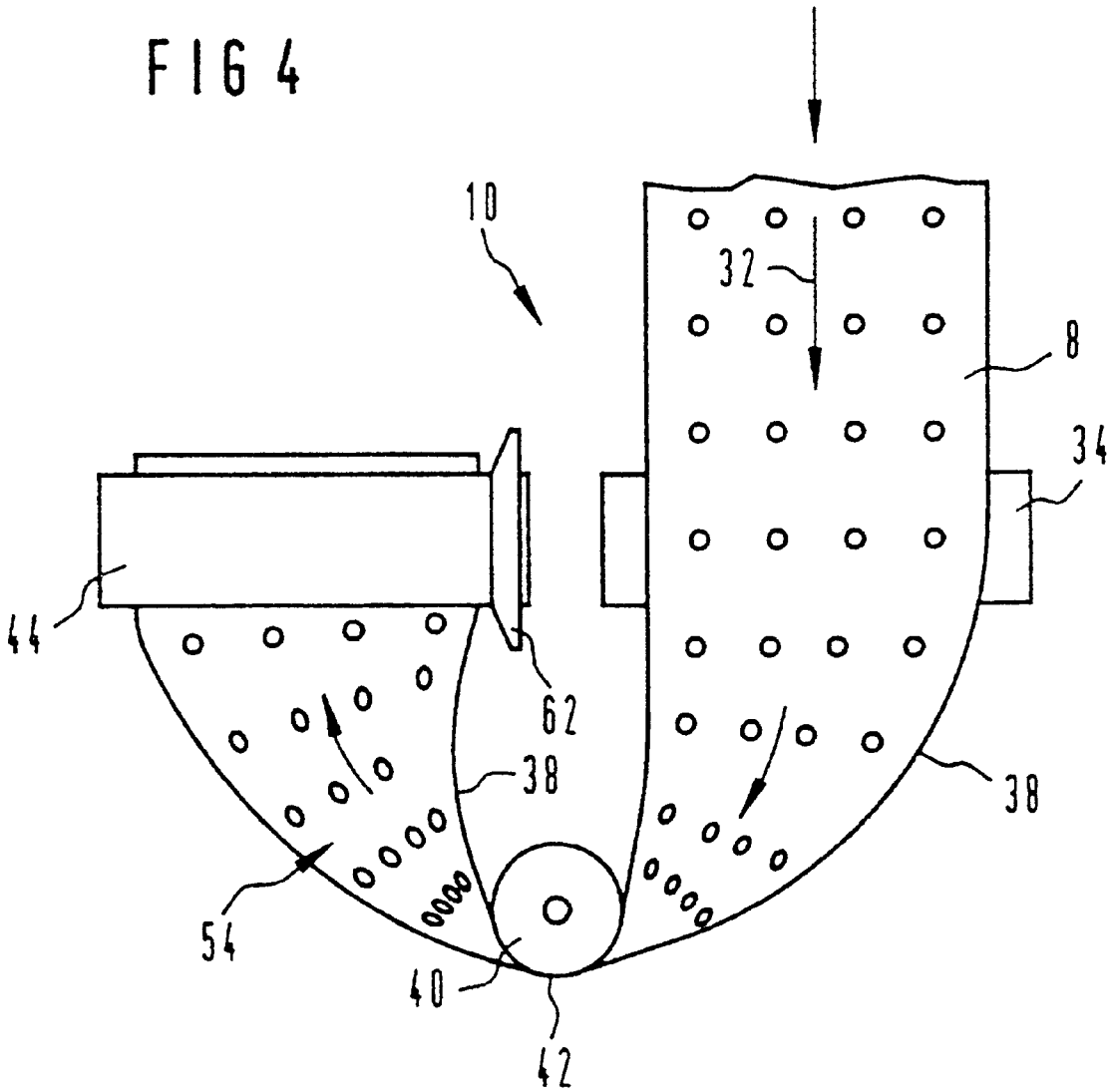
FIG. 4 shows the turning means according to FIG. 3, in a top view, FIGS. 5*a,* 5*b* and 5*c* show several exemplary embodiments of a diverting means.

FIG. 4 shows a top view of the turning means 18 according to FIG. 3. The diverting means 40 is a cylindrical in this case, and can for example be realized by a tube. However, other forms are also possible for the diverting means; it is essential only that the guide surface 42 be convexly curved, in order to support the formation of a round, natural web loop 54. The web output means 44 has, on the side facing the web supply means 34, a stop 62, on which the edge 38 of the web 8 rests. In this way, a precise orientation of the web 8 is possible for its further transport.

Figure 5A:
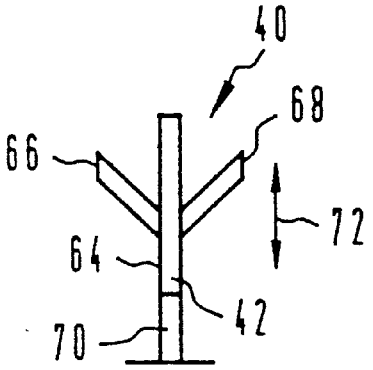
Figure 5B:
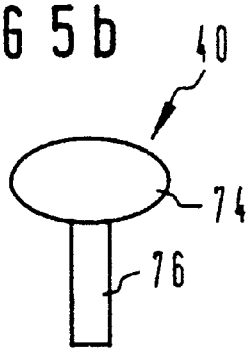
Figure 5C:
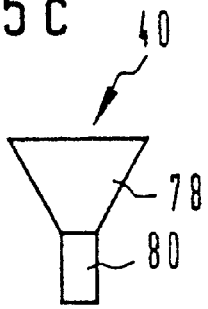

FIGS. 5*a*, 5*b* and 5*c* show further embodiments a, b, c of the diverting means 40. The embodiment shown in FIG. 5 has a lower cylindrical segment 64 that provides the curved guide surface 42. In the upper region of the diverting means 40, two arms 66 and 68 are flange-mounted, which run in a spread fashion at an angle of approximately 45° to the longitudinal axis of the diverting means 40. These arms 66 and 68 have the function of preventing a climbing up of the web 8. Such a climbing up can occur when there is a fluctuation of the friction on the guide surface 42, or when there is buckling of the web 8 at the folds. The arms 66 and 68 form second guide surfaces for the upper edge of the web 8, and stabilize the shape of the web loop 54.

The cylindrical segment 64 is adjustable in height in relation to a base 70, as indicated by the double arrow 72. The height adjustment can take place dependent on the required length of the web loop for a web storage function, as well as dependent on the form length of the web 8.

The exemplary embodiment in FIG. 5*b* shows an assembled rotation body, whose rotational surface is an ellipse 74 and a rectangle 76.

The exemplary embodiment in FIG. 5*c* shows an assemblage of a truncated cone 78 and a cylinder 80. The truncated cone 78 has the same function as that of the arms 66 and 68 according to the exemplary embodiment of FIG. 5*a,* whereby its upper guide surface is enlarged.

Figure 6:
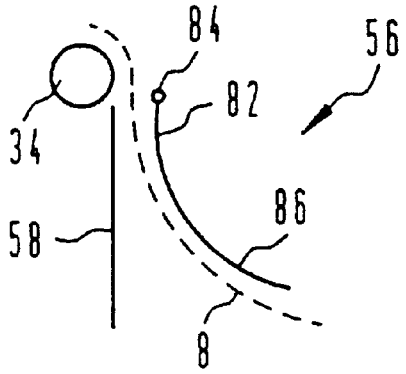
FIG. 6 is a schematic view which shows an embodiment of the web guide means.

FIG. 6 shows an exemplary embodiment of the web guide means 56. A material tab 82 is movably fastened with one end 84 to the side opposite the guide plate 58. The other end 86 rests on the surface of the web 8, and thus calms the transport movements of the web 8. In place of the material tab 82, a felt tab or a rubber sheet can also be used.

Figure 7:
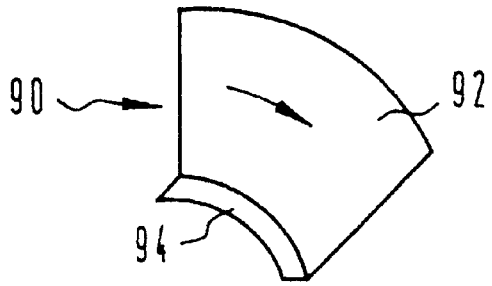
FIG. 7 is a schematic view which shows a guide element for supplying a first web segment during insertion operation.

FIG. 7 shows a guide element 90. This guide element 90 is arranged radially at a distance from the diverting means 40, underneath the web supply means 34. This guide element 90 has a guide surface 92 that is concavely curved and stands approximately upright, with a support edge 94 that projects approximately perpendicularly in the lower region. The guide element 90 serves to guide an initial segment of the web 8 around the diverting means 40 during insertion. In insertion, the initial segment is supplied via the web supply means 34, and its edge 38 reaches the support surface 94, along which it moves during the further conveying of the web 8. The surface of the web 8 rests on the curved guide surface 92, so that a curvature of the web 8 arises, and its front edge is led past the diverting means 40. An operator can now grasp this front edge of the web 8 and insert the web into the web output means 44 so as to form the web loop 54. By means of the guide element 90, jamming of the web is avoided during the insertion operation, and the inserting activity of the operator is made easier.

Figure 8:
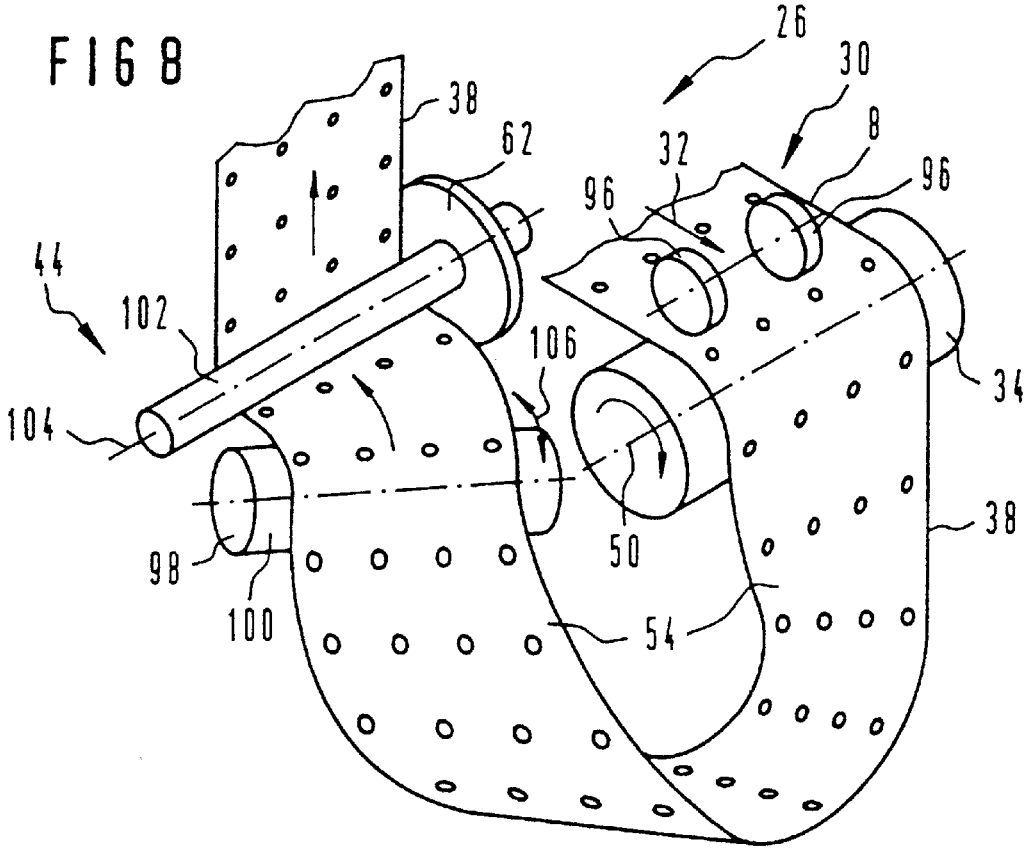
FIG. 8 is a perspective view which shows an exemplary embodiment of a displacement means.

FIG. 8 shows the displacement means 26 for displacing a web 8 by at least a web width. Identical parts already described are designated identically. The web 8 is supplied along the first transport path 30 from the transport direction 32 by means of the web supply means 34. The transport roll of the web supply means 34 has counterpressure rollers 96 that prevent climbing up of the web 8. The web 8 is supplied to a guide element 98 with its outermost edge 38, forming the web loop 54, in such a way that the edge 38 faces the web supply means 34. The web 8 slides over a guide surface 100 of the guide element 98 that is curved convexly. In the present case, the guide element 98 has a cylindrical surface. Immediately after the diversion at the guide element 98, the web 8 is supplied to a diverting element 102. The diverting element 102 has an axis 104 that is arranged in parallel to the axis 50 of the web supply means 34.

The guide element 98 can be pivoted in a horizontal plane by an angle according to the double arrow 106. By means of the angled arrangement of the guide element 98, the shape of the web loop 54 is held stable. By means of the arrangement of the diverting element 102 in the vicinity of the guide element 98, there ensues a diversion of the web 8 with a relatively large radius of curvature, so that creasing of the web 8 or formation of folds is avoided. The web 8 is then guided to possible further conveyor elements of the web output means 44.

The diversion element 102 has the stop 62, which serves for precise edge guiding, on its side facing the web supply means 34. Likewise, the guide element 98 can be provided with a corresponding stop on its right side. The stop 62 can be fashioned in such a way that it can be displaced in the direction of the axis 104, in order to be adapted to the web width.

Figure 9:
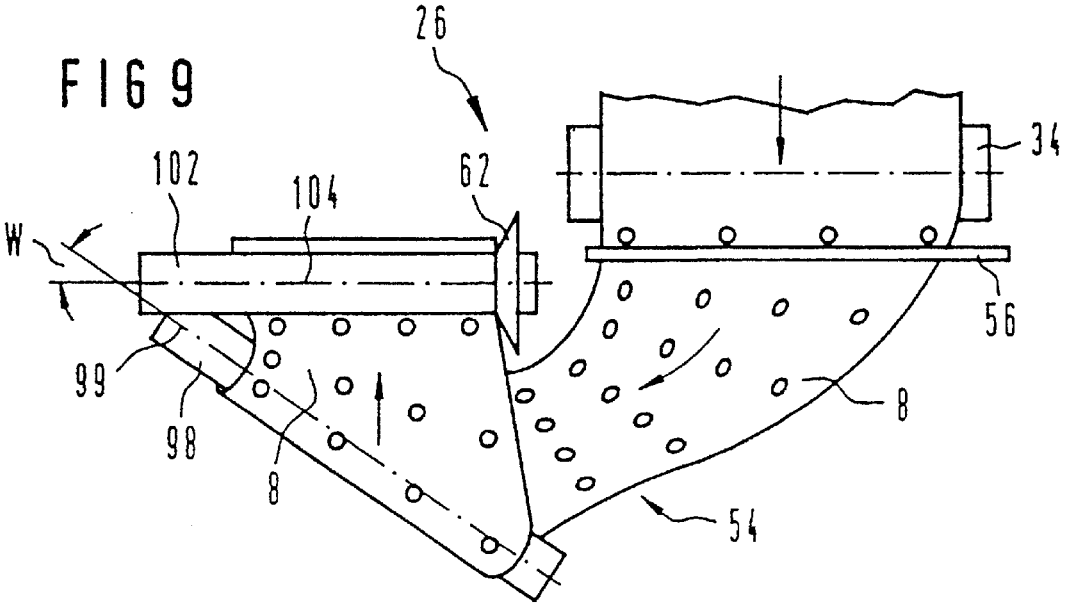
FIG. 9 shows the displacement means according to FIG. 8, in a top view.

FIG. 9 shows a top view of the displacement means 26 according to FIG. 8. The axes 99 and 104—projected in a horizontal plane—of the guide element 98, or, respectively, of the diverting element 102, form an angle w=20°. The guide element 98 in FIG. 9 can be pivoted by this angle w in the direction towards the diverting element 102, so that its axis 99 lies in a vertical plane with the axis 104. In this state, the unit formed from the guide element 98 and the diverting element 102 forms a guide means for guiding the web 8. This unit can be used in a turning means 18 according to FIG. 3, as a part of the web output means 44 shown there. In FIG. 9, the web guide means 56 can further be seen in a top view, which guide means 56 serves, as already stated, for the calming of the web run and the formation of the web loop 54.

Figure 10:
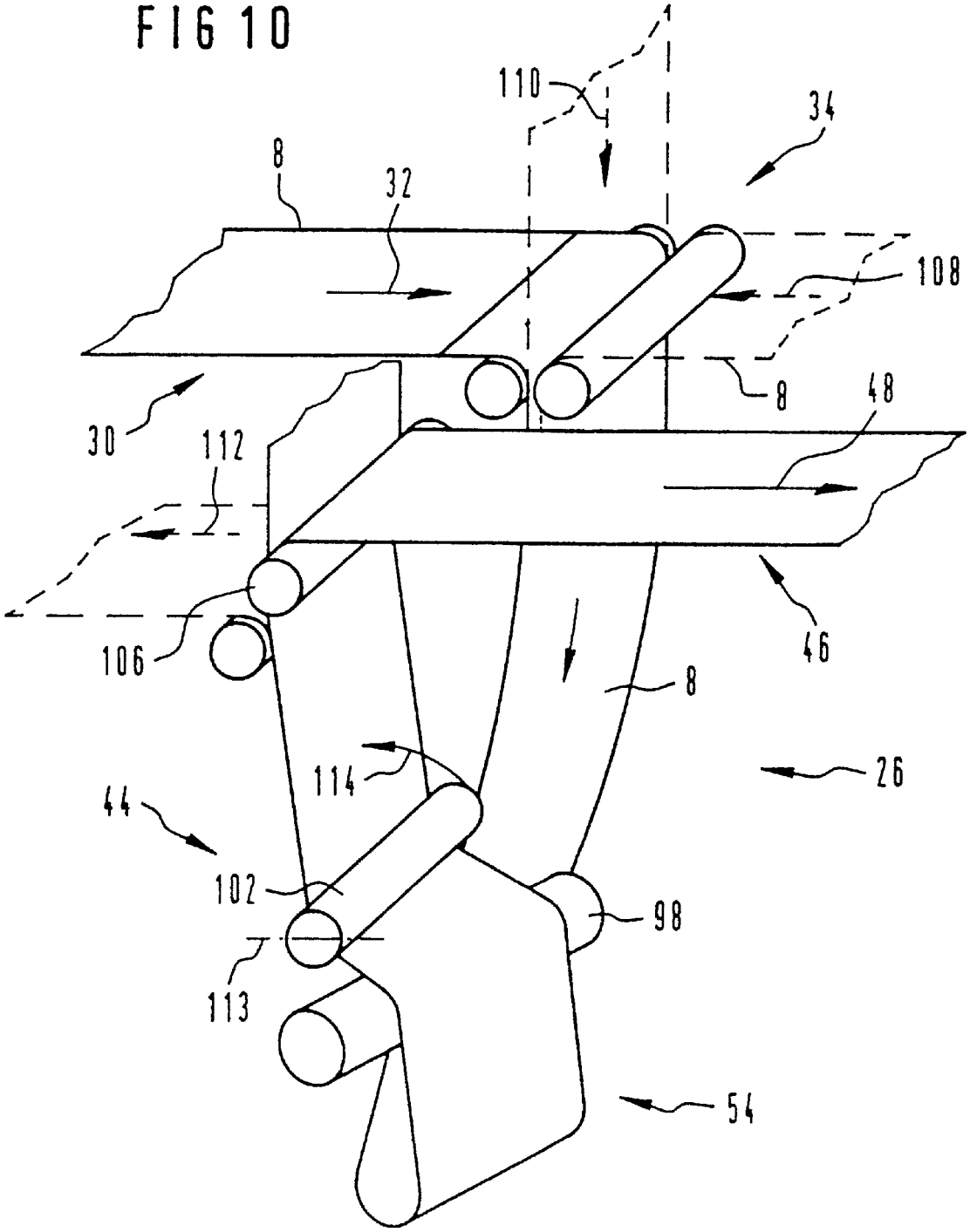
FIG. 10 is a perspective view which shows variants of the paper supplying for a displacement means according to the invention.

FIG. 10 shows various variants of the supplying and taking up of the web for the displacement means 26. The web 8, coming from the direction according to the arrow 32 along the transport path 30, is further conveyed in an corresponding direction of transport (as indicated by the arrow 48) via a further diverting roll 106, after passing through the web loop 54. The diverting roll 106 is a part of the web take-up means 44, with the further components of a guide element 98 and a diverting element 102. Further variants of the web supplying arrangements are shown in broken lines in FIG. 10. A web 8 supplied from the right according to the arrow 108 or from above (as shown by the arrow 110) is outputted to the left according to the arrow 112, via the diverting roll 106. As can be seen, the transport directions are in general determined in such a way that the web 8 is conveyed downstream in the direction of the print unit.

The adjustability of the diverting element 102 is also to be noted. In order to simplify the insertion process for the web 8, the diverting element 102 can be pivoted vertically upward about an axis of rotation 113 in the arrow direction 114. The operator can then guide the initial segment of the web 8 in the insertion operation about the diverting roll 106, and can subsequently pivot the diverting element 102 back into the position shown in FIG. 10.

Components of the turning means 18 and displacement means 26 shown in FIGS. 3 to 10 can be combined with one another. Thus, a diverting means similar to the diverting means 40 shown in FIG. 3 can be included in the embodiment according to FIG. 10. The web loop 54 is then laid about the diverting means 40, the guide element 98 is pivoted back to an angle w=0, and the web is guided through between the guide element 98 and the diverting element 102. Such an arrangement then has the function of a turning means. According to the type of operation desired, duplex unit or two-color simplex operation, the means according to FIG. 10 can be converted in a relatively short time into a turning means or a displacement means.

Although other modifications and changes may be suggested by those skilled in the art, it is the intention of the inventors to embody within the patent warranted hereon all changes and modifications as reasonably and properly come within the scope of their contribution to the art.

I claim:

1. An apparatus for turning and displacement of a web of endless recording material, comprising:

a web supply that guides the web along a first transport path from a transport direction, a diverter that is arranged underneath and after the web supply relative to the direction of transport, a web take-up above said diverter to carry away the web, said web take-up being next to the web supply and displaced therefrom by at least a width of the web, said diverter having a guide surface on which a first edge of the web facing the web take-up rests loosely, the web being guided upwards at an angle from said diverter to the web take-up, and said diverter having a side facing the web supply and said web being carried off generally from said side facing said diverter along a second transport path approximately in the direction of transport.

2. An apparatus according to claim 1, wherein said web supply includes a transport roll and at least one counterpressure roll between which the web is supplied.

3. An apparatus according to claim 1, further comprising:

a web guide to calm and loosely supplying the web, said web guide being arranged underneath the web supply.

4. An apparatus according to claim 3, wherein said web supply includes a support surface with a width that corresponds to at least the width of the web.

5. An apparatus as claimed in claim 1, wherein said web is a paper web.

6. An apparatus for turning and displacement of a web of endless recording material, comprising:

a web supply that guides the web along a first transport path from a transport direction, a diverter that is arranged underneath and after the web supply relative to the direction of transport, a web take-up above said diverter to carry away the web, said web take-up being next to the web supply and displaced therefrom by at least a width of the web, said diverter having a guide surface on which a first edge of the web facing the web take-up rests loosely, the web being guided upwards at an angle from said diverter to the web take-up, and said diverter having a side facing the web supply and said web being carried off generally from said side facing said diverter along a second transport path approximately in the direction of transport, wherein said diverter includes an oblong body whose longitudinal axis runs approximately vertically, and said first guide surface is convexly curved.

7. An apparatus according to claim 6, wherein said oblong body has a cylindrical lower segment.

8. An apparatus according to claim 6, wherein said guide surface is a first guide surface and said oblong body includes a second guide surface in its upper region, said second guide surface guides and holds down a second edge of the web when the web climbs up during its movement about the oblong body and exceeds a predetermined height.

9. An apparatus according to claim 8, wherein said second guide surface is formed by spread-out arms in a manner of a Y, and said spread-out arms lie within a plane that is at least approximately parallel to a web segment shortly after being supplied by the web supply.

10. An apparatus according to claim 9, wherein said spread-out arms are spread out at an angle of 30° to 60° from a longitudinal axis of the oblong body.

11. An apparatus according to claim 8, wherein said oblong body is mounted to be rotational.

12. An apparatus according to claim 11, wherein said oblong body is Y-shaped.

13. An apparatus according to claim 8, wherein said oblong body has at least in its upper part a shape of an inverted truncated cone.

14. An apparatus according to claim 8, wherein said first and the second guide surfaces are mounted to be adjustable in height.

15. An apparatus according to claim 14, further comprising:

a loop storage unit, and wherein said first and second guide surfaces provides height adjustment dependent on a required length of the web loop for said loop storage unit.

16. An apparatus for turning and displacement of a web of endless recording material, comprising:

a web supply that guides the web along a first transport path from a transport direction, a diverter that is arranged underneath and after the web supply relative to the direction of transport, a web take-up above said diverter to carry away the web, said web take-up being next to the web supply and displaced therefrom by at least a width of the web, said diverter having a guide surface on which a first edge of the web facing the web take-up rests loosely, the web being guided upwards at an angle from said diverter to the web take-up, and said diverter having a side facing the web supply and said web being carried off generally from said side facing said diverter along a second transport path approximately in the direction of transport, a web guide to calm and loosely supplying the web, said web guide being arranged underneath the web supply, wherein said web supply includes a support surface with a width that corresponds to at least the width of the web, wherein said web guide includes a movable support element that moves a front side of the web against the support surface with friction.

* * * * *